United States Patent [19]

Isahaya

[11] 4,185,971

[45] Jan. 29, 1980

[54] ELECTROSTATIC PRECIPITATOR

[75] Inventor: Fumio Isahaya, Tokyo, Japan

[73] Assignee: Koyo Iron Works & Construction Co., Ltd., Tokyo, Japan

[21] Appl. No.: 919,324

[22] Filed: Jun. 26, 1978

[30] Foreign Application Priority Data

| | | | |
|---|---|---|---|
| Jul. 14, 1977 | [JP] | Japan | 52-83526 |
| Nov. 1, 1977 | [JP] | Japan | 52-130245 |
| Apr. 21, 1978 | [JP] | Japan | 53-46645 |

[51] Int. Cl.[2] ..... B03C 3/10

[52] U.S. Cl. ..... 55/113; 55/118; 55/119; 55/120; 55/121; 55/149; 55/151; 55/296

[58] Field of Search ..... 55/13, 14, 7, 8, 113, 55/118, 120, 119, 121, 122, 135, 146, 149, 151, 296

[56] References Cited

U.S. PATENT DOCUMENTS

| | | | |
|---|---|---|---|
| 916,746 | 3/1909 | Morscher | 55/13 |
| 1,412,248 | 4/1922 | Laughlin | 55/149 |
| 1,828,646 | 10/1931 | Dantsizen | 55/13 |
| 2,696,892 | 12/1954 | Campbell | 55/121 |

FOREIGN PATENT DOCUMENTS

| | | | |
|---|---|---|---|
| 103160 | 12/1925 | Austria | 55/135 |
| 114795 | 5/1929 | Austria | 55/121 |
| 258521 | 10/1970 | U.S.S.R. | 55/149 |

*Primary Examiner*—Bernard Nozick

*Attorney, Agent, or Firm*—Fidelman, Wolffe & Waldron

[57] ABSTRACT

The present invention relates to an electrostatic precipitator comprising a cylindrical precipitation electrode having a discharge electrode disposed along the central axis thereof and rotatably supported in an inclined or horizontal manner, a driving means for rotating said precipitation electrode at a low speed, and a dust removing device having a plurality of scrapers aligned in the vicinity of the lower inner surface of said precipitation electrode; and characterized in that the dust adhering to the inner surface of the precipitation electrode is scraped off by said scrapers and led to one end of the precipitation electrode so as to be exhausted therefrom.

9 Claims, 12 Drawing Figures

ELECTROSTATIC PRECIPITATOR

SUMMARY OF THE INVENTION

The present invention relates to an electrostatic precipitator for catching solid or liquid corpuscles floating in pollution gas, i.e., dust, mist and fume, by sticking them on the inner surface of a precipitation electrode by means of corona discharge. The present invention particularly relates to a means of removing the dust, mist and fume from the precipitation electrode.

In a general electrostatic precipitator, dust, mist and fume adhere to the inner surface of a precipitation electrode and accumulate there. The precipitated dust, mist and fume cause spark over or short circuit between the precipitation electrode and a discharge electrode disposed inside the precipitation electrode. Therefore, they must be removed from the precipitation electrode.

First object of the present invention is to provide a device for entirely removing the dust from the precipitation electrode.

A known device for removing the dust is shown in FIG. 1 of the accompanying drawing. A bar 22 attached to the bottom of a precipitation electrode 21 is striken with a hammer 23. Dust 24 adhering to the electrode 21 peels off by the accelerated vibration of the electrode 21 and drops by its gravity. When the dust 24 drops, it is partly flown by the flow of pollution gas 25 and escapes from an exit end of the device together with clean gas 26.

Second object of the present invention is to provide a means of preventing the dust from escaping.

Dust adheres to a precipitation electrode in various states, e.g. in a state of paste such as tar or oil fume, in a state of sludge or in a state of liquescent dust. Such dust never peels off only by striking the electrode. A known method of removing such dust is shown in FIG. 2 of the accompanying drawing. Water 28 is flown on the inner surface of a cylindrical precipitation electrode 27 when it is rotating. Water 28 spreads over the inner surface of the electrode 27 by its rotation so as to sweep away the dust from the electrode and becomes waste water 29. It is required to separate the dust from the waste water 29. It needs high technique, large equipment and much cost.

Third object of the present invention is to provide a means of removing the dust from a precipitation electrode without needing large equipment and much cost.

Fourth object of the present invention is to provide a relatively small and cheap apparatus by which a quantity of pollution gas can be treated at once.

Other objects of the present invention will be apparent from the following detailed description of the invention.

The electrostatic precipitator of the present invention comprises a cylindrical precipitation electrode having a discharge electrode disposed along the central axis thereof and rotatably supported in an inclined or horizontal manner, a driving means for rotating the precipitation electrode at a low speed, and a dust removing device having a plurality of scrapers aligned in the vicinity of the lower inner surface of the precipitation electrode in a fixed or slidable manner, and is characterized in that the dust adhering to the precipitation electrode is scraped off by the scrapers and led to one end of the electrode so as to be exhausted therefrom.

BRIEF DESCRIPTION OF THE DRAWING

FIG. 3 is a sectional elevation view showing a first embodiment of the precipitator;

FIG. 4 is a perspective view showing a first embodiment of a dust removing device;

FIGS. 5(A), 5(B) and 5(C) are perspective views showing three modifications of the device of FIG. 4;

FIG. 6 is a sectional elevation view showing a second embodiment of a dust removing device;

FIG. 7 is a sectional elevation view showing a third embodiment of a dust removing device;

FIG. 8 is a perspective view showing a fourth embodiment of a dust removing device;

FIG. 9 is a sectional elevation view showing a second embodiment of the precipitator; and FIG. 10 is a perspective view showing a dust removing device used for the precipitator of FIG. 9.

DETAILED DESCRIPTION OF THE INVENTION

The present invention is described hereinafter in accordance with the accompanying drawings.

Figure 1:
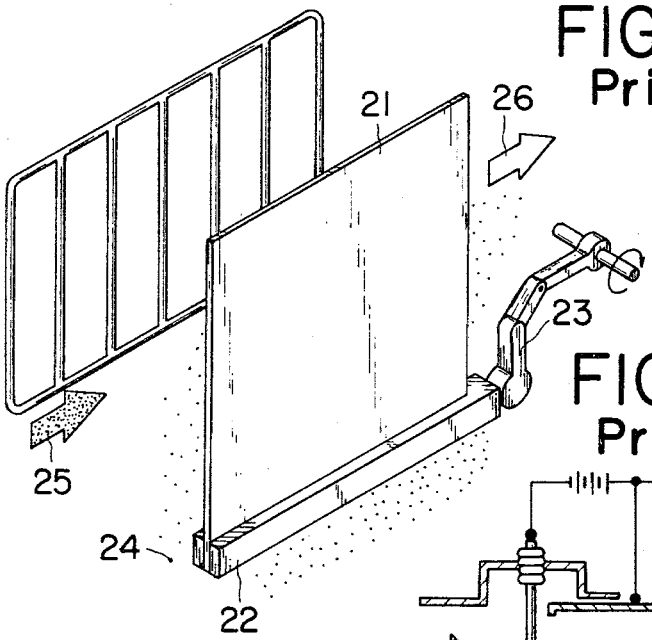
FIG. 1 Prior art
FIG. 1 is a perspective view showing a prior art.
Figure 2:
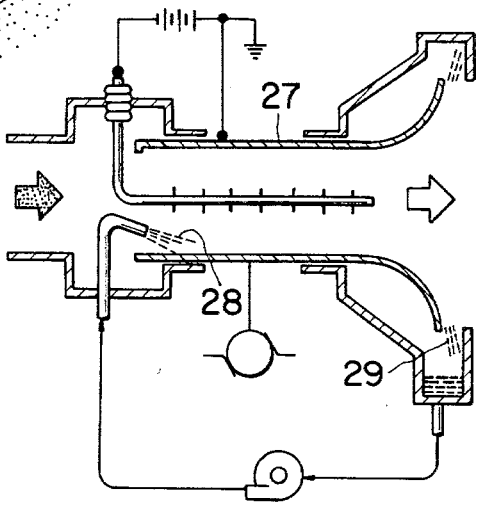
FIG. 2 Prior art
FIG. 2 is a sectional elevation view showing other prior art.
Figure 3:
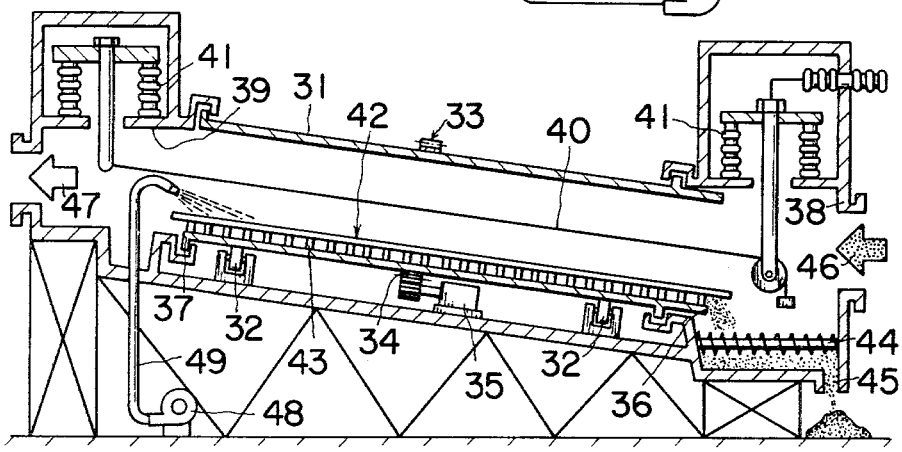
FIGS. 3–10 show the electrostatic precipitator of the present invention.

FIG. 3 is a sectional elevation view showing a first embodiment of the electrostatic precipitator of the present invention. A cylindrical precipitator electrode 31 is rotatably supported by means of a plurality of guide rollers 32. Said electrode 31 is inclined in the drawing. However, it may be horizontal. The electrode 31 is rotated at a low speed by means of a driving means 33. The driving means 33 comprises a decelerator 34 consisting of a large gear fixed on the outer periphery of the electrode 31 and a small gear engaging with the large gear, and a motor 35 for driving the small gear. The decelerator 34 may be a combination of a chain and sprockets, or of a belt and pulleys. Both ends 36 and 37 of the electrode 31 are respectively connected to an entrance casing 38 and an exit casing 39. A discharge electrode 40 is disposed along the central axis of the electrode 31. Both ends of the discharge electrode 40 are supported by insulators 41 disposed inside the casings 38 and 39. The discharge electrode 40 may be a long wire or bar. A dust removing device 42 has a plurality of scrapers 43. The scrapers 43 are aligned in the vicinity of the lower inner surface of the electrode 31. The entrance end 36 of the electrode 31 is disposed above a screw conveyor 44. A dust exhaust port 45 is disposed below the end of the conveyor 44.

Pollution gas 46 enters the electrode 31 from the entrance casing 38. When the pollution gas 46 passes between the precipitation electrode 31 and the discharge electrode 40, the dust in the gas 46 is charged with electricity. The charged dust adheres to the inner surface of the electrode 31. Therefore, the pollution gas 46 becomes clean gas 47. The clean gas 47 exhausts from the exit casing 39.

The dust adhering to the inner surface of the electrode 31 is scraped off by means of the scrapers 43. The scrapers 43 can scrape off any sort of dust which does not peel by hammering. Because the electrode 31 is always rotating, the scrapers 43 can scrape off the dust from the whole inner surface of the electrode. The scrapers 43 leads the scraped dust to the end 36 by utilizing the inclination and rotation of the electrode 31. The leading operation of the scrapers 43 will be described later in detail. The dust drops onto the screw conveyor 44 from the end 36. The conveyor 44 carries the dust to the exhaust port 45.

It is quite possible that the dry dust flys up when it is scraped off. Such flying dust is flown by the flow of the clean gas 47. The precipitator of FIG. 3 has a means for moistening the dry dust. Such moistening means consists of a pump 48 and a pipe 49 in the drawing. However, any sort of moistening means may be used. A little liquid or steam is given from the upper end 37 of the electrode 31 so as to moisten the whole inner surface of the electrode 31 by the inclination and rotation thereof. Liquid is required only for moistening the dust adhering to the electrode but not for sweeping it away. That means the present precipitator does not need any device or cost for treating waste liquid.

Moistening the dust increases the adhesion of the dust and lowers the electric resistance of the dust. Therefore, the dust adheres to the electrode 31 very well and never flys up. Moreover, such moistened dust is convenient when it is stored, packed and transported after it was exhausted from the exhaustion port 45.

A sprayer disposed on the entrance side of the pollution gas 46 may be used instead of said moistening means.

A dust removing device is described hereinafter.

Figures 4, 5:
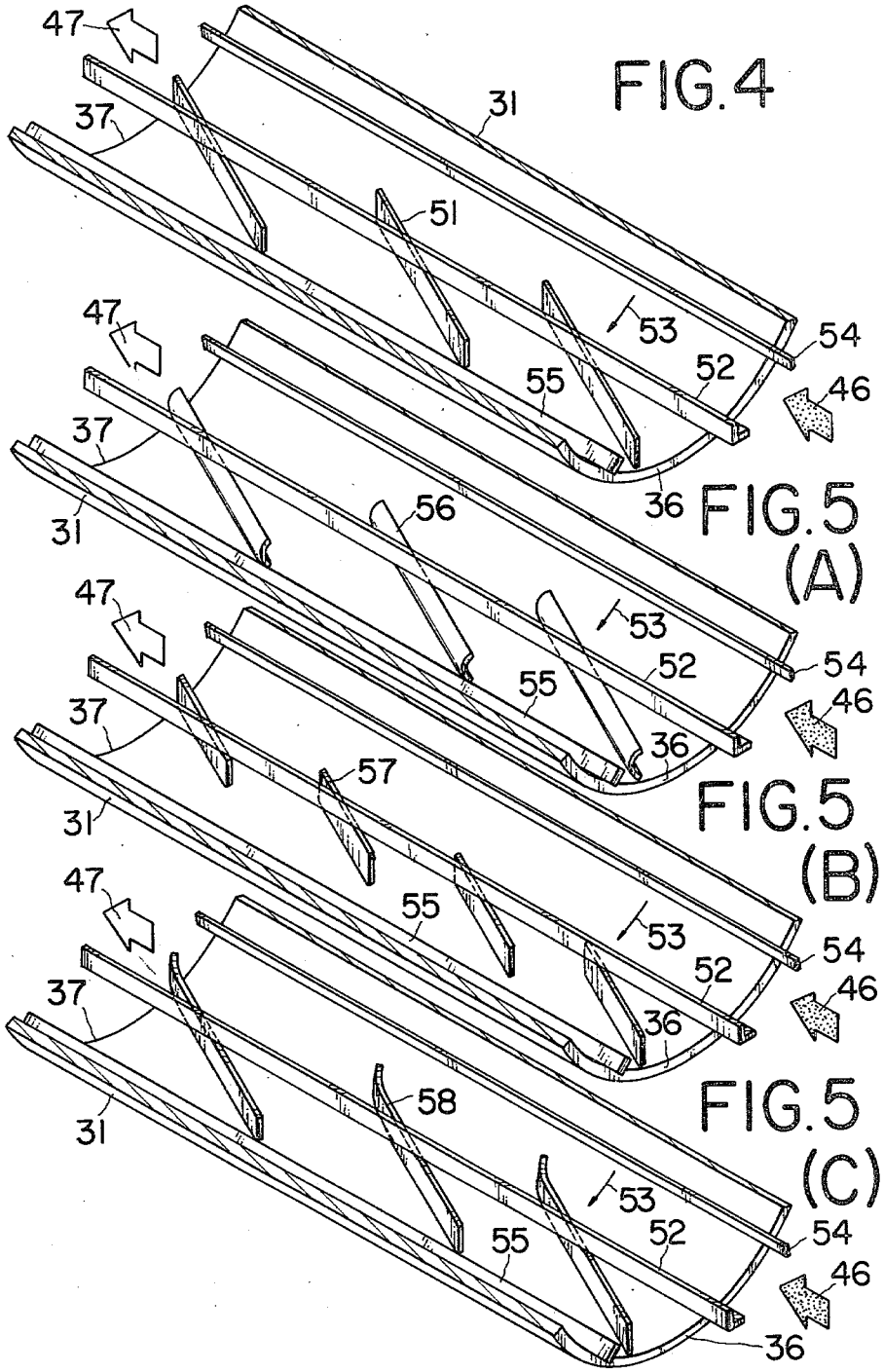

FIG. 4 shows a dust removing device 50 in which scrapers do not move. The device 50 consists of a fixed bar 52 and a plurality of scrapers 51 of rectangular plates. The bar 52 is disposed in the vicinity of the lower inner surface of the electrode 31 in parallel with the surface. Both ends of the bar 52 are fixed outside the electrode 31. Each scraper 51 is fixed to the lower side of the bar 52. The lower side of each scraper 51 lightly contacts the inner surface of the electrode 31. Scrapers 51 are aligned in parallel with each other in such a manner that they are inclined with respect to the rotational center of the electrode 31 so that the dust can be easily scraped off in accordance with the rotation of the electrode 31.

In FIG. 4, the electrode 31 rotates in the direction of arrow 53. The dust adhering to the inner surface of the electrode 31 is scraped off by the scrapers 51. The scraped dust moves along the front surface of each scraper 51 in accordance with the rotation of the electrode 31. Because each scraper 51 is inclined so as to lead the scraped dust toward the lower end 36 of the electrode 31, the dust drops therefrom.

The scraped dust sometimes moves upwards with the rotation of the electrode 31. Such dust drops from the upper part. When it drops, it is flown by the flow of the clean gas 47. Two plates 54 and 55 are disposed on both sides of the bar 52 so that the dust can not move upwards. They are fixed in parallel with the bar 52. The lower side of both plates 54 and 55 lightly contact the inner surface of the electrode 31 or disposed slightly away from the inner surface.

FIGS. 5(A), 5(B) and 5(C) show modifications of the shape and attachment of scrapers. Scrapers 56 shown in FIG. 5(A) are curved and fixed to the bar 52. The concave surface of the scraper 56 is looking upward so that the dust can be scraped off well. The scraper 56 also prevents the scraped dust from going over the scraper. The embodiment of FIG. 5(B) is characterized by the arrangement of scrapers 57. Lower scrapers are disposed backward in comparison with higher scrapers so that the scraped dust is led gradually to the next lower scrapers. Therefore, the dust securely and quickly reaches the end 36 of the electrode 31. A scraper 58 of FIG. 5(C) has a curve at its foward end. The concave part of the curve is looking upward. The scrapers 58 scrape off the dust well and sufficiently leads the dust downward.

The scrapers of FIGS. 4 and 5 scrape off the dust by utilizing the rotation of the precipitation electrode 31. That means scrapers themselves do not move. It makes the construction of the dust removing device simple. Therefore, the device is cheap, troubleless and simple in maintenance.

Figure 6:
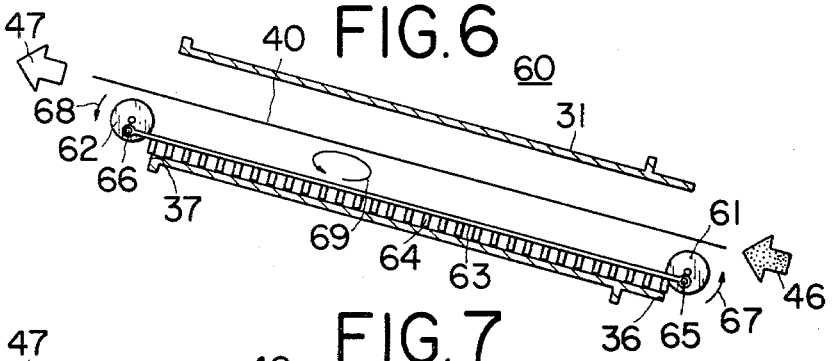
Figure 7:
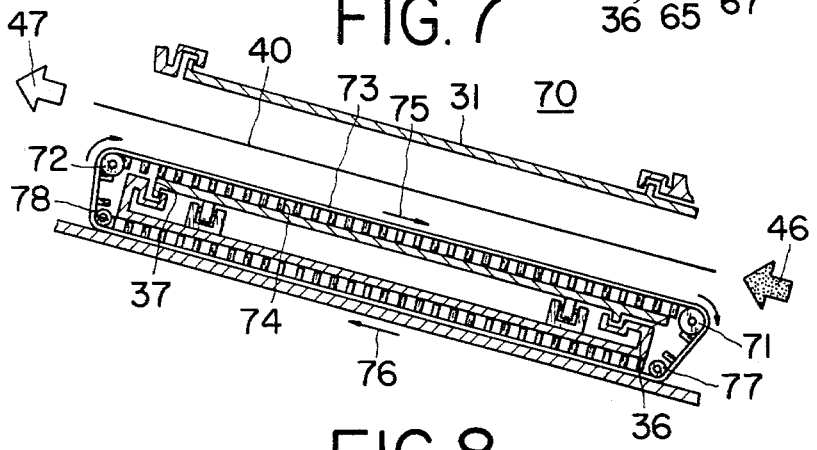
Figure 8:
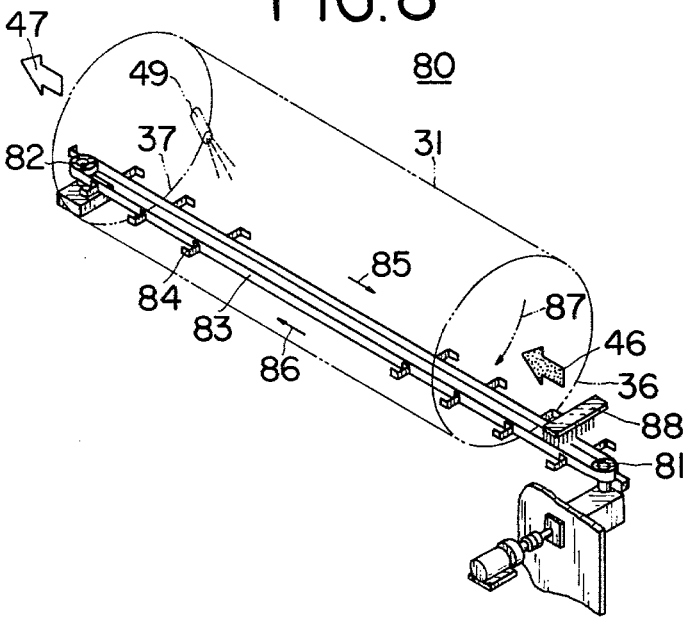

In the embodiments of FIGS. 6 to 8, scrapers move in the longitudinal direction of the cylindrical electrode.

A dust removing device 60 of FIG. 6 consists of two wheels 61 and 62, a movable bar 63 and a plurality of scrapers 64. Both wheels 61 and 62 are disposed outside the precipitation electrode 31. At least one of the wheels 61 and 62 is driven by a driving means not shown in the drawing. Both ends of the movable bar 63 are respectively pivotably connected to side surfaces of both wheels 61 and 62 by means of pins 65 and 66. The scrapers 64 are fixed to the lower surface of the movable bar 63 perpendicularly with respect to the rotational axis of the electrode 31. When the wheels 61 and 62 rotate in the direction indicated by arrows 67 and 68, the bar 63 moves as indicated by arrow 69. The scrapers 64 lightly contact the inner surface of the electrode 31 intermittently in accordance with the motion of the bar 63. When they contact the inner surface of the electrode 31, they scrape off the dust. Simultaneously the scrapers 64 push the scraped dust downward in accordance with the motion 69. The dust is pushed gradually downward by the scrapers 64 and reaches the end 36 of the electrode 31.

A dust removing device 70 of FIG. 7 consists of a belt 73 passing over two pulleys 71 and 72 disposed exteriorly of the precipitation electrode 31 and a plurality of scrapers 74 attached to the inner surface of the belt 73. The belt 73 moves along the lower inner surface of the electrode 31 in the direction of arrow 75 and further moves in the direction of arrow 76 outside the electrode 31 so as to form a loop. When the belt 73 moves in the direction of the arrow 75, the scrapers 74 scrape off the dust, and carry the scraped dust to the end 36 of the electrode 31. Reference numerals 77 and 78 designate other pulleys for the belt 73.

A combination of sprockets and a chain or of drums and a wire may be used instead of the combination of the pulleys 71 and 72 and the belt 73. This is also applicable to the embodiment described later.

In a dust removing device 80 of FIG. 8, a belt 83 is disposed only inside the precipitation electrode 31. Therefore, the size of the dust removing device 80 is smaller than that of the device 70 of FIG. 7. Further, any equipment or cost for additional pulleys 77 and 78 is not required.

When the precipitation electrode 31 rotates in the direction of arrow 87, the dust adhering to the inner surface of the electrode 31 reaches the scraping side of the belt 83. Scrapers 84 attached to the scraping side of the belt 83 scrape off the dust as the belt 83 moves in the direction of arrow 85. The scraped dust is carried to the end 36 of the electrode 31 by the scrapers 84. The scrapers 84 pass over a pulley 81 and move in the direction of arrow 86 along the inner surface of the electrode 31 where the dust has been already scraped off, and reach a pulley 82.

If the dust remains on the scrapers, the efficiency of the scrapers is deteriorated. The dust removing device 80 has a cleaner 88 to drop the dust remaining on the scrapers 84. In FIG. 8, a fixed brush is shown as the cleaner 88. The cleaner 88 is used after the dust has mostly dropped from the end 36 of the electrode 31. A rotating brush may be used instead of the fixed brush. A jet means to blow air or steam to the scrapers 84 may also be used instead of the fixed brush. The dust remaining on the scrapers 84 is brushed off by the brush or blown off by the jet means. Such cleaner 88 may also be used in the dust removing devices shown in FIGS. 7 and 9. However, it cannot be used in the dust removing devices shown in FIGS. 4 to 6, wherein scrapers do not circulate.

Figure 9:
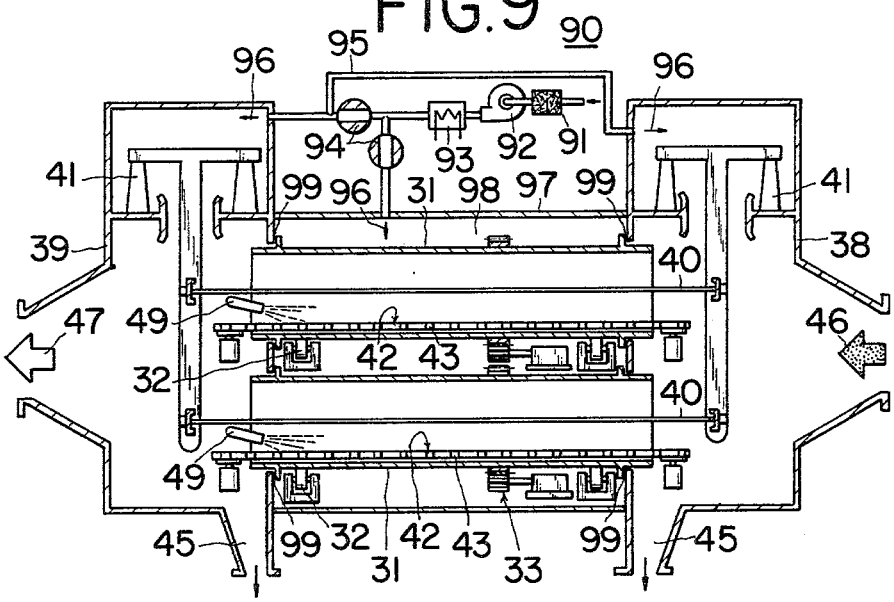

FIG. 9 shows a second embodiment of the electrostatic precipitator in which a large quantity of pollution gas is treated. The precipitator 90 has two sets of precipitation electrodes 31 such as shown in FIG. 3. Reference numerals same as in FIG. 3 designate the same parts.

A circuit 95 consists of an air filter 91, a blower 92, an air preheating means 93 and a damper 94 for controlling the blow-strength. The circuit 95 supplies clean air 96 to the surroundings of each insulator 41. The clean air 96 is partly led to a space 98 which is provided outside the precipitation electrodes 31 and surrounded by an outer cylinder 97 both ends of which are tightly fixed to wall surfaces of the entrance and exit casings 38 and 39. The pressure of the clean air 96 is a little higher than that of gas passing through inside each electrode 31. Therefore, the clean air 96 prevents the pollution gas 46 and the clean gas 47 from escaping from each gap at each bearing 99 of the entrance and exit casings 38 and 39 supporting both ends of each electrode 31. Namely, high precision of each bearing 99 is not necessary.

Figure 10:
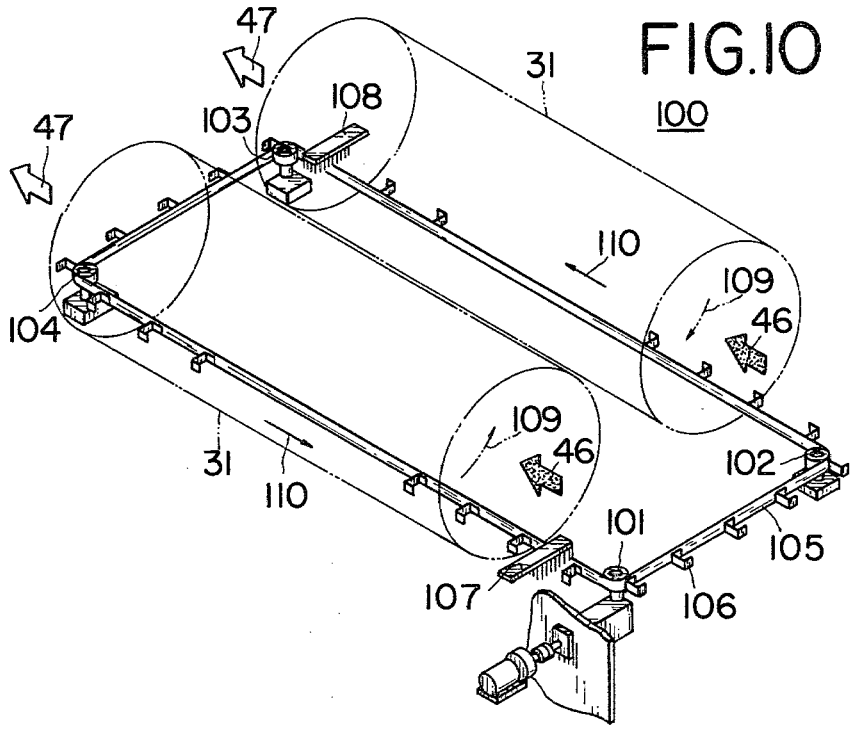

FIG. 10 shows a dust removing device 100 suitable for the electrostatic precipitator 90 of FIG. 9. In the drawing, one dust removing device is used for two precipitation electrodes. However, it is also possible to use one dust removing device for more than three precipitation electrodes. The dust removing device 100 consists of a belt 105 forming a loop by passing over four pulleys 101, 102, 103 and 104 and a plurality of scrapers attached to the belt 105. The belt 105 circulates in the longitudinal direction of each electrode 31 along the lower inner surface thereof so that the scrapers 106 can scrape off the dust from the two electrodes 31. That means the device 100 is cheaper than two dust removing devices separately provided for two electrodes 31.

Reference numerals 107 and 108 designate cleaners. Arrow 109 indicates the direction in which the electrodes 31 rotate. Arrow 110 indicates the direction in which the belt 105 circulates.

The electrostatic precipitator of the present invention has the following effects in addition to the abovementioned effects:

(1) Flying up of the precipitated dust is completely avoided with a relatively simple construction without any man for operation and maintenance. Namely, the present precipitator is economical and high in efficiency.

(2) Because the cylindrical electrodes are disposed in a horizontal or inclined manner, the precipitator can be installed even in places where height is limited, e.g. underground streets, underground parking places, tunnels or buildings.

What is claimed is:

1. An electrostatic precipitator comprising a cylindrical precipitator electrode having a discharge electrode disposed along the central axis thereof said precipitation electrode being rotatably supported in an inclined or horizontal manner, means for rotating said precipitation electrode at a low speed, a dust removing device including a belt to which a plurality of plate-type scraping members are attached, a pair of pulleys disposed exteriorly of said precipitation electrode means to drive said belt in the longitudinal direction of said precipitation electrode along the lower inner surface thereof with said scraping members in contact with the inner surface of the precipitation electrode, and a cleaner disposed in the vicinity of said belt outside the precipitation electrode for cleaning dust adhering to each of said scraping members thereby preparing said scraping members for repeated use.

2. An electrostatic precipitator of claim 1 wherein said cleaner is a fixed or rotatable brush the forward end of which contacts each of said scraping members.

3. An electrostatic precipitator of claim 1 wherein said cleaner is a jet means to blow air or steam to each of said scraping members.

4. An electrostatic precipitator comprising a cylindrical electrode having a discharge electrode disposed along the central axis thereof and rotatably supported in an inclined or horizontal manner, means for rotating said precipitation electrode at a low speed, a dust removing device including a support having a plurality of plate-type scraping members aligned in the vicinity of the lower inner surface of said precipitation electrode, means for driving said support to move said scraping members in the direction of and in contact with the inner bottom surface of said precipitation electrode, and means for supplying liquid to the bottom inner surface of said precipitation electrode thereby moistening the dust which is being scraped.

5. An electrostatic precipitator of claim 4 wherein said means for supplying liquid is disposed at an upper end of the inclined precipitation electrode.

6. An electrostatic precipitator of claim 5 further comprising a cleaner disposed in the vicinity of said dust removing device outside the precipitation electrode for removing dust adhering to each of said scraping members thereby preparing said scraping members for repeated use.

7. An electrostatic precipitator comprising a plurality of cylindrical precipitation electrodes each precipitation electrode having a discharge electrode disposed along the central axis thereof and being rotatably supported in an inclined or horizontal manner, means for rotating said precipitation electrodes at a low speed, a dust removing device provided for each of said precipitation electrodes and including a support having a plurality of plate-type scraping members aligned in the vicinity of the lower inner surface of said precipitation electrode, an outer casing which houses all of said precipitation electrodes, and means for supplying clean air to space between said outer casing and said precipitation electrodes.

8. An electrostatic precipitator comprising a plurality of cylindrical precipitation electrodes each precipitation electrode having a discharge electrode disposed along the central axis thereof and being rotatably supported in an inclined or horizontal manner, means for rotating each precipitation electrode at a low speed, a dust removing device provided for each of said precipitation electrodes including a plurality of plate-type scraping members, a cleaner provided in the vicinity of said dust removing device for cleaning said scraping members an outer casing which houses all of said precipitation electrodes, means for supplying clean air to space between said outer casing and said precipitation electrodes, said dust removing device including a belt carrying said scraping members, means for supporting said belt in the vicinity of lower inner surface of each precipitation electrode, and means for moving said belt in the longitudinal direction of each precipitation electrode with said scraping members in contact with the inner surface of each precipitation electrode.

9. An electrostatic precipitator comprising a plurality of cylindrical precipitation electrodes each precipitation electrode having a discharge electrode disposed along the central axis thereof and being rotatably supported in an inclined or horizontal manner, means for rotating each precipitation electrode at a low speed, a dust removing device provided for each of said precipitator electrodes and having a plurality of plate-type scraping members, means for supplying liquid to the bottom inner surface of each of said precipitation electrode thereby moistening the dust which is being scraped, an outer casing which houses all of said precipitation electrodes, and means for supplying clean air to space between said outer casing and said precipitation electrodes.

* * * * *